US006178596B1

(12) United States Patent
Choi

(10) Patent No.: US 6,178,596 B1
(45) Date of Patent: Jan. 30, 2001

(54) APPARATUS FOR ADJUSTING ANGLE OF BACK SEAT FOR VEHICLE

(75) Inventor: Hyoung Il Choi, Seoul (KR)

(73) Assignee: Koryo Co., Ltd., Kyungki-do (KR)

( * ) Notice: Under 35 U.S.C. 154(b), the term of this patent shall be extended for 0 days.

(21) Appl. No.: 09/233,424

(22) Filed: Jan. 20, 1999

(51) Int. Cl.[7] ..... E05D 11/10

(52) U.S. Cl. ..... 16/325; 16/324; 297/367; 297/366

(58) Field of Search ..... 16/325, 324, 322, 16/326; 297/354.12, 365, 367, 366, 364, 378.1, 378.12

(56) References Cited

U.S. PATENT DOCUMENTS

| | | | | |
|---|---|---|---|---|
| 4,082,352 | * | 4/1978 | Bales et al. | 297/364 |
| 4,087,885 | * | 5/1978 | Gillentine | 16/325 |
| 4,103,970 | * | 8/1978 | Homier | 297/367 |
| 4,175,301 | * | 11/1979 | Letournoux et al. | 16/324 |
| 4,435,013 | * | 3/1984 | Arihara | 297/364 |
| 5,664,837 | * | 9/1997 | Takagi | 297/367 |
| 5,685,611 | * | 11/1997 | Eguchi et al. | 297/367 |
| 5,762,400 | * | 6/1998 | Okazaki et al. | 297/367 |

* cited by examiner

*Primary Examiner*—Chuck Y. Mah
(74) *Attorney, Agent, or Firm*—Arent Fox Kitner Plotkin & Kahn, PLLC

(57) ABSTRACT

An apparatus that accurately adjusts the angle of the back of a seat that prevents the twist caused by an external impact to a vehicle to mitigate the risk of injury. The apparatus includes turning pieces, each of which are mounted to supporting brackets that are fixed to both ends of a seating portion and back of the seat. The turning pieces are connected on a connecting shaft and are turned by means of an actuating lever. The apparatus for adjusting the angle of the back includes a concave portion in an arc formed on one surface of a turning piece connected to the back of the turning pieces on the connecting shaft. A guiding protrusion having an upper end in a cylindrical form on the connecting shaft such that it is guided in the concave portion by surface contact on one surface of the turning piece connected to the seating portion of the turning pieces. A guiding groove including a slanting jaw is bent such that it is concaved perpendicularly in the middle of the guiding protrusion and both side surfaces of the upper end are inclined inwardly. A latch portion is concaved in the guiding groove to control the stop and turn of the turning piece by lifting and lowering. An actuating portion arranged in the rectangular hold of the lifting and lowering piece turns on the connecting shaft to life or lower the lifting and lowering piece.

5 Claims, 6 Drawing Sheets

APPARATUS FOR ADJUSTING ANGLE OF BACK SEAT FOR VEHICLE

BACKGROUND OF THE INVENTION

1. Field of the Invention

The present invention relates to an apparatus for adjusting angle of the back of a seat for a vehicle, and more particularly to an apparatus for adjusting angle of the back of a seat for a vehicle by which the angle can be adjusted accurately without any malfunction when the angle of the back is adjusted to provide comfort for a driver or a passenger, and which the twist caused by the external impact is prevented in driving a vehicle to mitigate the risk of the safety accident to the minimum.

2. Description of the Prior Art

Generally, a seat for a vehicle comprises a front seat, which is constituted by a driver's seat and a front passenger's seat, and a rear seat on which passengers are seated. The front seat is provided such that the driver or the passenger is seated comfortably on the seat, and that the distance in front and rear of the seat and the angle of the back is adjusted freely on the basis of a figure of the driver, whereby the driver can drive the vehicle safely in the most comfortable posture and the passenger can be seated on the passenger's seat in the most comfortable posture.

Such a seat for a vehicle is provided with an apparatus for adjusting the angle of the back of a seat. FIG. 1 shows an apparatus for adjusting the angle of the prior art. As shown in FIG. 1, a turning bracket 31 is mounted on a fixed bracket 11 connected to both sides of the rear of a seat 10 respectively, the turning bracket 31 is connected to a back 30, and mounted on the fixed bracket 11 such that the turning bracket 31 is turned on a hinge 20. On the outer surfaces of the turning bracket is mounted a ratchet 32 having a gear 33 formed thereon. A gear 42 is formed on the upper surface of a actuating piece 40, which is arranged beneath the ratchet and turned by means of the fixed bracket 11 and a hinge 41. The gear 42 is engaged with the gear 33. A actuating lever 50 is provided for adjusting a position of the actuating piece. The actuating lever 50 has one end connected by means of the hinge. The actuating lever 50 includes a guiding hole 51 which is formed at the middle thereof and which a guide pin 43 formed at the end of the actuating piece is inserted in. To a fixing rail 60 for fixing the lower part of the one end of the actuating lever and the seat is connected a elastic spring 70 for lowering the actuating lever by virtue of its own elasticity.

With the apparatus for adjusting the angle of the back of prior art as described above, the actuating lever remains lowered by virtue of the elasticity of the elastic spring, as shown in FIG. 1*a*, so that the guide pin inserted in the guiding hole is positioned at the upper end of the guiding hole, and the end of the actuating piece is lowered on the hinge. As a result, the gear of the actuating piece and the gear of the ratchet remain engaged with each other, thus the back is locked.

To adjust the angle of the back in the above mentioned conditions, as shown in FIG. 1*b*, the end of the actuating lever is pulled upward so that the actuating lever is turned on the hinge. Consequently, the guide pin inserted in the guiding hole is positioned at the lower end of the guiding hole, and the actuating piece is lowered on the hinge. As a result, the gears engaged are separated from each other.

After the angle of the back is adjusted for the comfort of the users, released is the actuating lever which is pulled.

Then, the actuating lever is lowered on the hinge by virtue of the elasticity of the elastic spring. The guide pin is positioned at the upper end of the guiding hole and the end of the actuating piece rises on the hinge, as shown in FIG. 1*b*, by the turned angle of the guiding hole. Consequently, the gears are engaged with each other to lock the back at the adjusted angle.

However, the apparatus for adjusting the angle of the back of the prior art as described above adjusts the angle of the back and therefore locks the back at the adjusted angle, however, in that the actuating lever is actuated by virtue of the elasticity to turn the actuating piece, thus the gears formed on the actuating piece and the ratchet are engaged with each other or separated from each other. Consequently, if the external impact, such as shock from the collision of the vehicle in driving the vehicle, the actuating lever may be turned. As a result, the actuating piece is turned on the hinge by the turned angle of the actuating lever, therefore the gears engaged may be separated from each other. In this case, the upper part of the body of the driver is moved forward by the turning of the back forward. Accordingly, the upper part of the body is dashed against the steering wheel to lose his life from the safety accident.

SUMMARY OF THE INVENTION

Accordingly, it is a primary object of the present invention is to provide an apparatus for adjusting the angle of a seat of a vehicle by which the angle of the back can be adjusted accurately at the discretion of the user, the adjusted back is not turned voluntarily even though the impact is applied on the back, the upper part of the body of the user is not moved forward by turning of the back, and the upper part of the body is not dashed against the steering wheel, therefore his life can be protected from the safety accident.

The foregoing object is accomplished in one embodiment by providing an apparatus for adjusting angle of the back of a seat for a vehicle having turning pieces each of which is mounted to supporting brackets fixed to both ends of the seating portion and the back, the turning pieces being connected on a connecting shaft and being turned by means of an actuating lever, the apparatus for adjusting angle of the back comprising: a concave portion in an arc formed on one surface of the turning piece connected to the back of the turning pieces on the connecting shaft; a guiding protrusion having the upper end in a cylindrical form on the connecting shaft such that it is guided in the concave portion by the surface contact on one surface of the turning piece connected to the seating portion of the turning pieces; a guiding groove including a slanting jaw bent such that it is concaved perpendicularly in the middle of the guiding protrusion and the both side surfaces of the upper end are inclined inwardly; a latch portion concaved in the guiding groove for controlling the stop and the turn of the turning piece by lifting and lowering; and an actuating portion arranged in the rectangular hole of the lifting and lowering piece for turning on the connecting shaft to lift or lower the lifting and lowering piece.

BRIEF DESCRIPTION OF THE DRAWINGS

The preferred embodiment of the present invention will now be described by way of example with reference to the accompanying drawings in which.

DETAILED DESCRIPTION OF THE PREFERRED EMBODIMENT

Figure 1A:
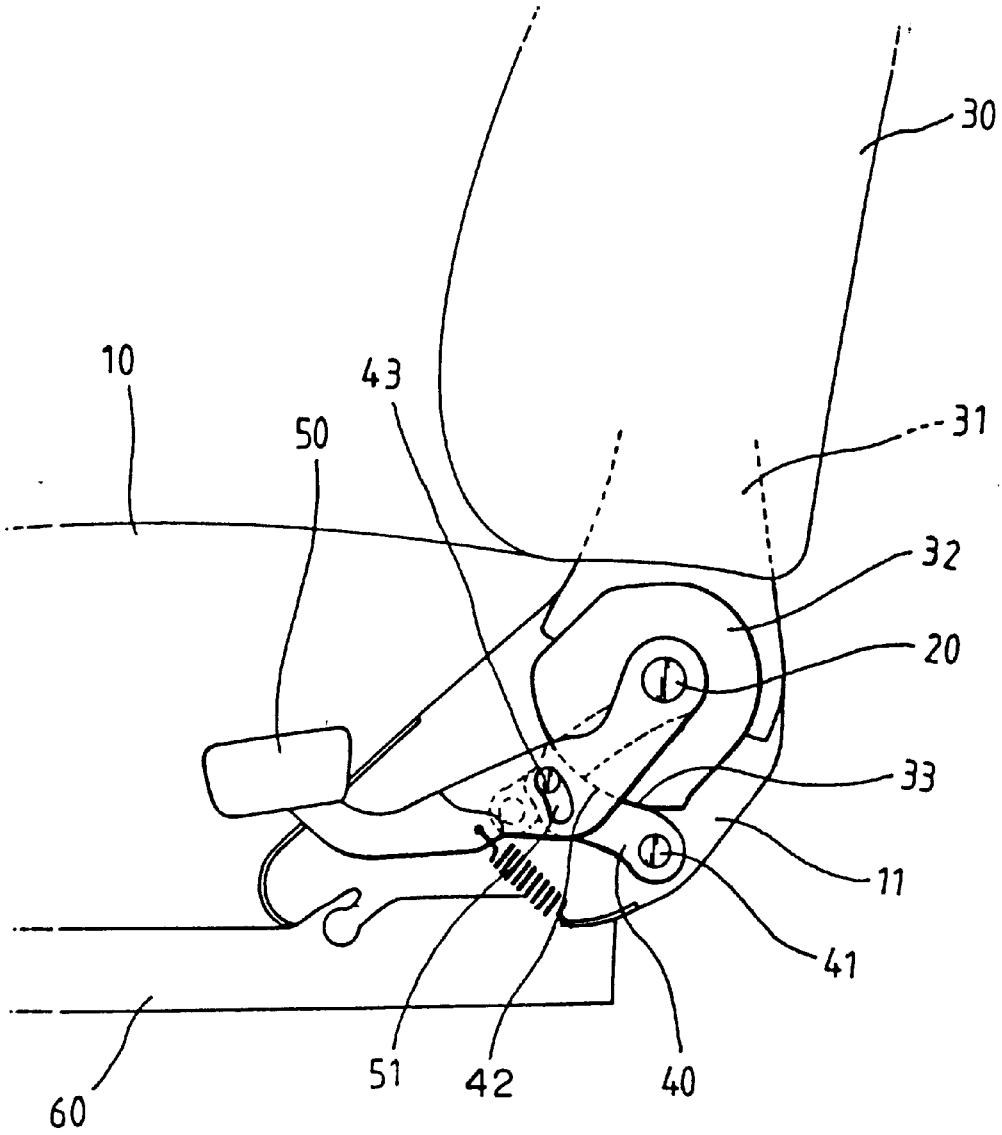
FIG 1a PRIOR ART
FIGS. 1*a* and 1*b* are side views showing the construction of an apparatus for adjusting the angle of the prior art.
Figure 1B:
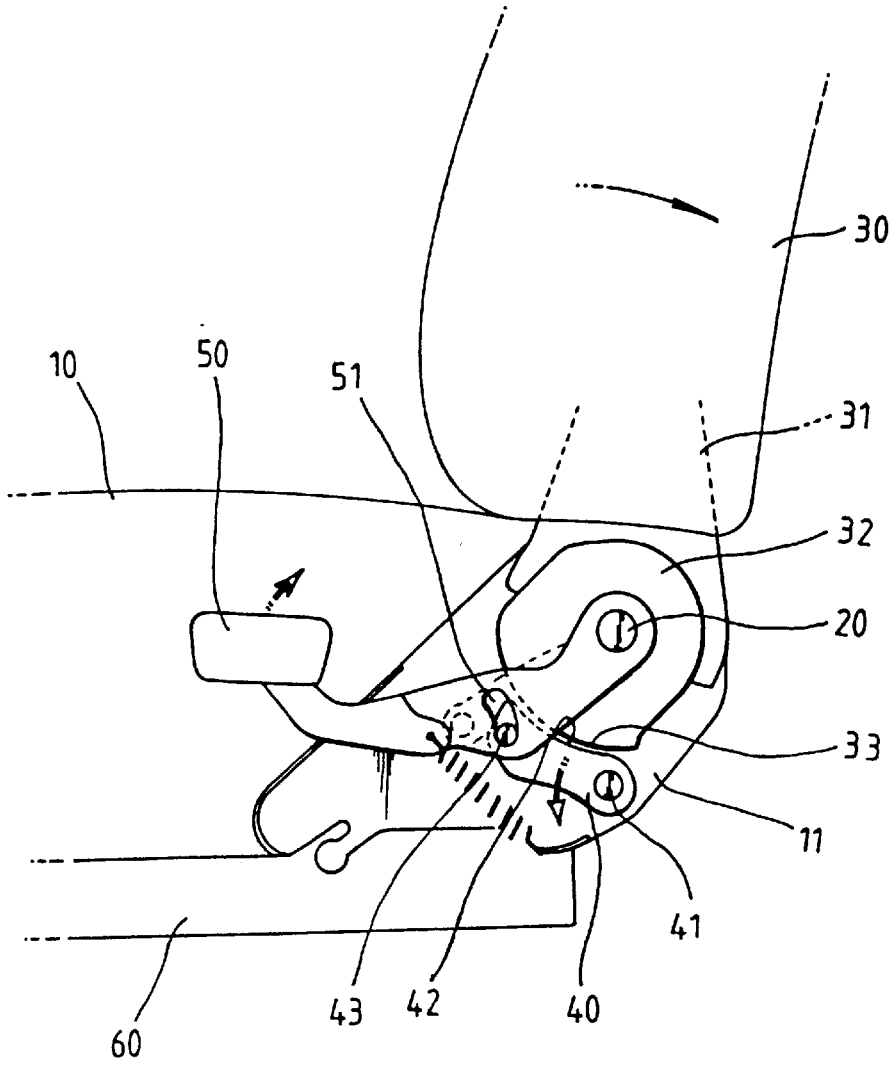
FIG 1b PRIOR ART
Figure 2:
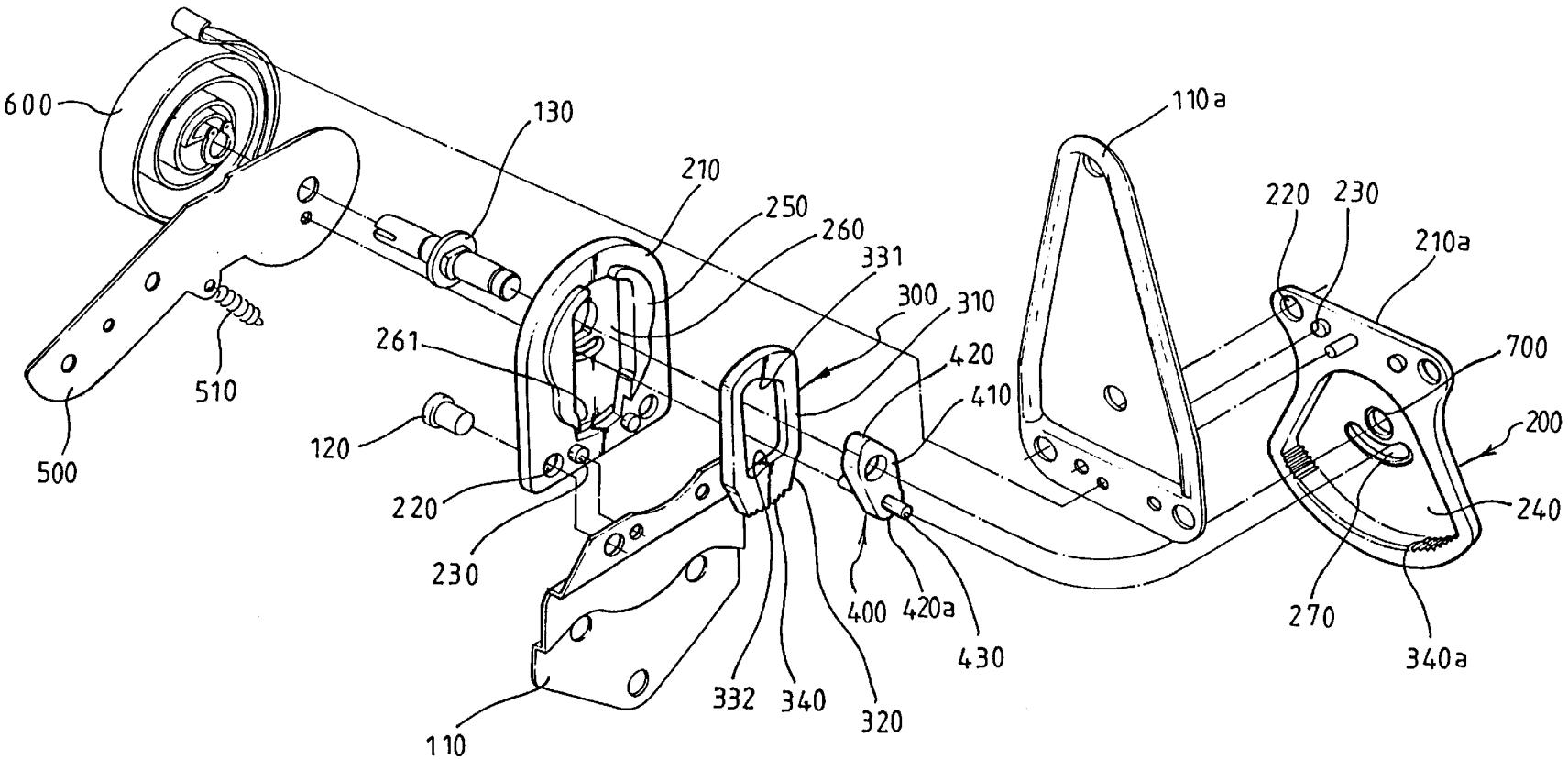
FIG. 2 is a exploded perspective view showing the construction of an apparatus for adjusting the angle according to the present invention.

Referring now to the drawings, especially FIG. 2, there is illustrated the construction of an apparatus for adjusting the angle according to the present invention in an exploded perspective view. As shown in FIG. 2, at the lower end of the supporting brackets 110, 110*a* fixed to both ends of the seating portion and the back is connected both ends of the apparatus for adjusting the angle of the seat, which are connected by means of the connecting shaft 130 which penetrates the central part. To both ends of a turning portion 200 for turning on the connecting shaft which includes turning pieces 210, 210*a* in any form is provided a penetrating hole 220 connected by means of a supporting bracket and a coupling rivet 120, and a coupling protrusion 230 formed integrally. On one surface of the turning piece 210*a* connected to the back of the turning pieces is formed a concave portion 240 in an arched form on the connecting shaft. On one surface of the turning piece connected to the seating portion of the turning pieces is formed a guiding protrusion 250 having the upper end in a cylindrical form on the connecting shaft such that it is guided in the concave portion by the surface contact. Provided is a guiding groove 260 including a slanting jaw 261 bent such that it is concaved perpendicularly in the middle of the guiding protrusion and the both side surfaces of the upper end are inclined inwardly.

Also provided is a latch portion 300 concaved in the guiding groove for controlling the stop and the turn of the turning piece by lifting and lowering, which includes a lifting and lowering piece 310 in the form of a plate concaved in the concave portion, a concave surface 320 formed on the lower ends of both sides of the lifting and lowering piece, the concave surface being concaved inwardly to contact the slanting jaw 261, a rectangular hole 330 arranged at the middle of the lifting and lowering piece in the form of the rectangle, the rectangular hole having inclined surfaces 331, 332 of which the upper and lower surfaces is inclined in the same direction, and gears 340, 340*a* engaged with each other in the lower end surface of the lifting and lowering piece and the inner surface of the lower end of the concave portion 240.

Also provided is an actuating portion 400 arranged in the rectangular hole of the lifting and lowering piece for turning on the connecting shaft 130 to lift or lower the lifting and lowering piece, which includes an actuating cam 410 turned by the connecting shaft and having contacting surfaces 420, 420*a* moved along the inclined surfaces formed at the upper and lower ends of the rectangular hole, and a guide pin 430 protruded at the front and rear of the lower end of the actuating cam and inserted in a guide hole 270 formed on the turning pieces 210, 210*a*.

Also provided is an actuating lever 500 having one end thereof connected to the connecting shaft outside the turning piece 210 and supported elastically by an elastic spring 510 connected to the fixing rail to which the lower end of the middle portion and the seat is fixed, for turning the actuating cam 410. Furthermore, provided is a plate spring 600 wounded on the outer surface of the actuating lever and having one end connected to the connecting shaft and the other end connected to the supporting bracket 110 of the back to move the back forward by virtue of its own elasticity.

When the hole and the guide hole for the turning piece 210, 210*a* is formed, residues (A) are left at the corners thereof. As a result, the surfaces become rough. In order to avoid the occurrence of malfunction by the residues using an additional manual operation even though the above residues are not removed, a stepped portion 700 is provided by which the circumferences of the corners are inserted in the inner sides. Consequently, the residues are collected in the lower end of the stepped portion, so that the malfunction does not occur even though the residues are not removed.

The operation of the apparatus for adjusting the angle of the back of the seat according to the present invention, as described above, will now be explained with reference to FIG. 3 and FIG. 4.

Figure 3:
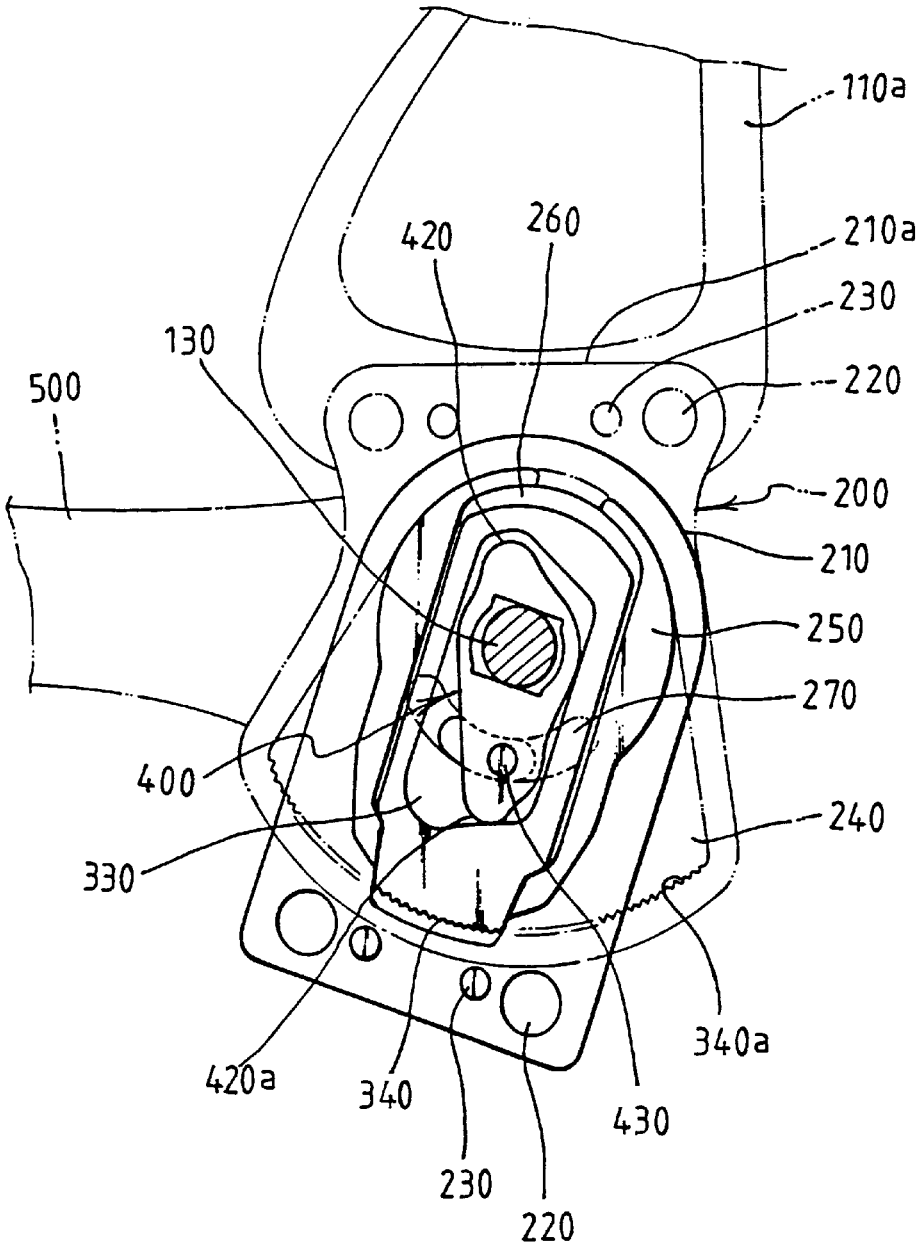
FIG. 3 shows an operational status of the apparatus for adjusting the angle according to the present invention, in which the back of the seat is locked.

As one end of the actuating lever 500, which is wounded on the connecting shaft 130 in the outer surface of the turning piece 210 connected to the seating portion and is supported elastically by the elastic spring 510 at the one end, is lowered, the actuating cam 410 is placed at the position as illustrated in FIG. 3. That is to say, the lower end of the actuating cam is place at the end of the lower inclined surfaces 332, and the upper end thereof is placed at the end of the upper inclined surface 331. As a result, the lifting and lowering piece 310 is lowered and the gear 340 formed on the lifting and lowering piece and the gear 340A formed on the inner side of the lower end of the concave portion 240 remain engaged with each other, therefore the turning piece 210*a* is not turned and remains unmoved.

Figure 4:
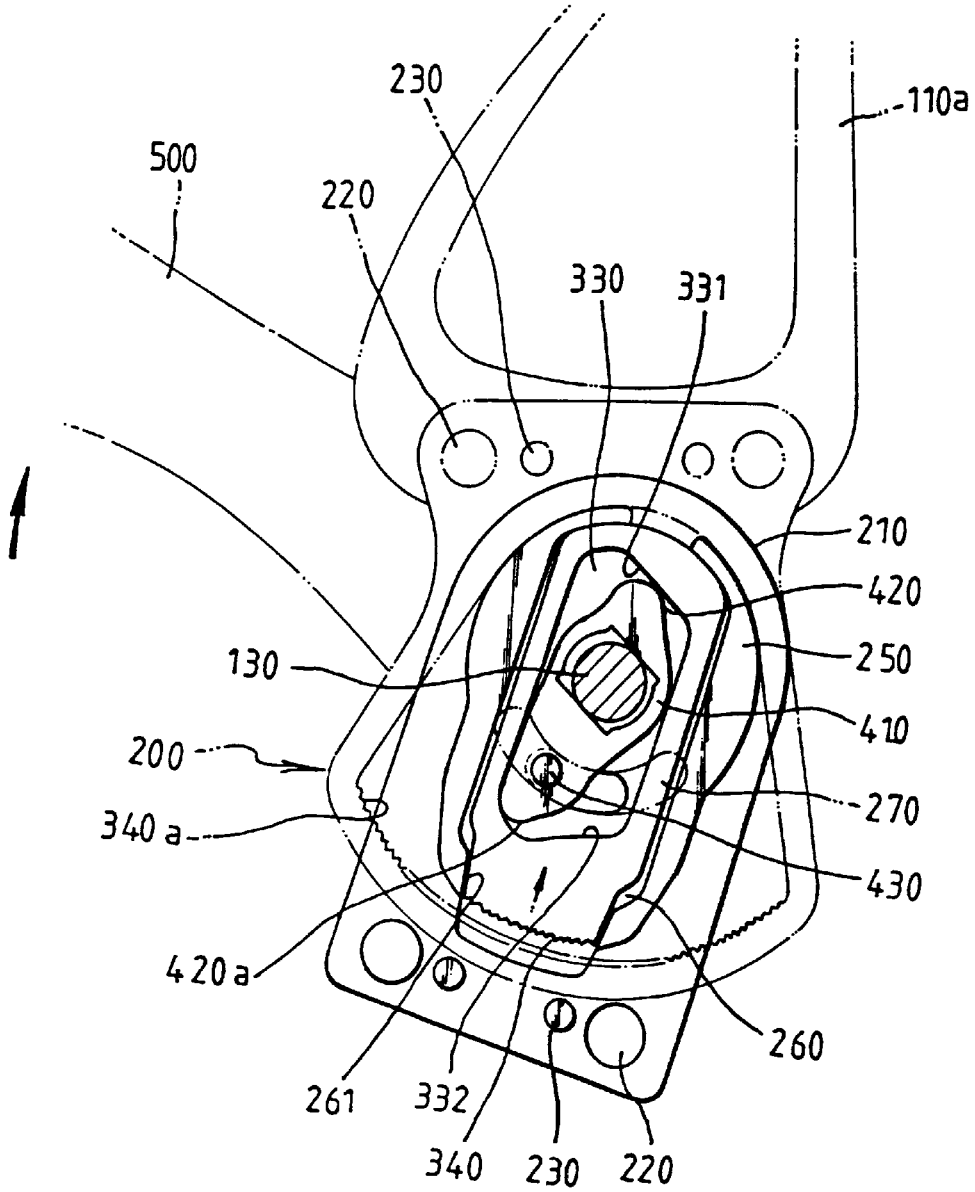
FIG. 4 shows an operational status of the apparatus for adjusting the angle according to the present invention, in which the angle of the back is adjusted.
Figure 5:
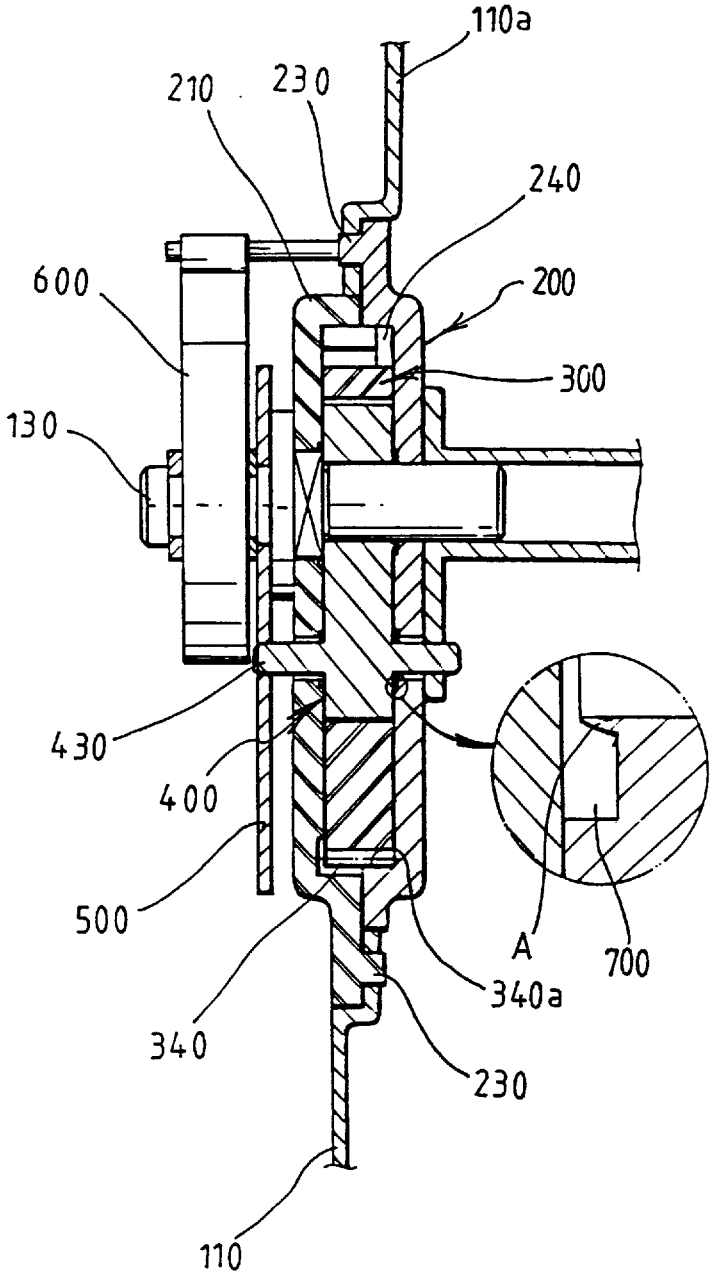
FIG. 5 is a side cross-sectional view showing the construction of the present invention with parts enlarged.

To adjust the angle of the back in the above mentioned conditions for the comfort of driver or passenger, as shown in FIG. 4, the actuating lever 500 is pulled upward so that the plate spring 600 is wounded by force and the actuating cam 410 is turned by the rotating of the connecting shaft 130. By returning of the actuating cam, the upper end is turned along the inclined surface 331 arranged on the upper end of the rectangular hole 330, and the lower end is separated from the lower inclined surface 332. Consequently, the lifting and lowering piece 310 rises vertically in the guiding groove 260, thus the gears 340, 340*a* engaged with each other remain separated from each other.

If the gears are separated from each other as mentioned above, the turning piece 210*a* can be turned freely on the connecting shaft 130. At this time, the force for turning the back forward occurs by virtue of the elasticity of the plate spring 600. The back is moved forward unless the external force is applied to the back. If it is required to move the back backward, the back is pushed backward until the back arrives at the desired angle so that the turning piece 210*a* is turned on the connecting shaft 130 to adjust the angle of the back.

At this time, the turning motion of the turning piece 210*a* is carried out stably as all the outer circumference of the upper end of the guide protrusion 250 remain in surface contact with the concave portion 240. Furthermore, since the contacting area with the turning piece 210, 210*a* is relatively wide, the impact under the fixed is endured at the occurrence of the safety accident to prevent any damage due to the impact.

After the adjustment of the angle of the back is completed, the lifted actuating lever 500 is lowered by virtue of the elasticity of the elastic spring 600 if the actuating lever 500, which is pulled upwardly, is released. As a result, the connecting shaft 130 is rotated to turn the actuating cam 410 in the direction opposite to the former direction so that the lifted lifting and lowering piece 310 is lowered. Consequently, the gear 340 formed on the lower end of the lifting and lowering piece is engaged with the gear 340*a* formed on the lower of the concave portion 240 of the turning piece 210*a* to stop the turning of the turning piece 210*a*, as shown in FIG. 3.

That is, if the actuating cam 410 is turned in the FIG. 4, the upper and lower ends of the actuating cam are moved to the upward direction of the inclined surfaces 331*m* 332 formed on the upper and lower surfaces of the rectangular hole 330. Consequently, the lifting and lowering piece 310 is separated downwardly by means of the actuating cam 410, and the gear 340 formed on the lower end of the lifting and lowering piece is engaged with the gear 340*a* formed on the lower end of the concave portion 240, to stop the turning motion of the turning piece 210*a*. As a result, the back remains locked at the adjusted angle.

At this time, a minute clearance is provided for carrying out the smooth action of the lifting and lowering piece between the guiding groove 260 and the lifting and lowering piece 310. When the lifting and lowering piece is lowered, the vertex of each slanting jaw 261 formed at the lower end of the lifting and lowering piece and that of the concave portion 320 are contacted, so that the shaking does not occur due to the clearance of the lifting and lowering piece, thus the gears 340, 340*a* are engaged with each other accurately.

According to the present invention as described above, as the lifting and lowering piece is lifted or lowered in accordance with the turning direction of the actuating cam turned by the actuating lever to carry out the motion for engagement or separation so that the turning piece is moved or locked, the gears are not separated from each other even though the external impact, such as the impact caused from the collision is applied to the vehicle in driving of the vehicle. Consequently, the back is not moved forwardly voluntarily, so that the upper part of the body is not dashed against the steering wheel to avoid the safety accident, and the turning piece is not twisted or damaged easily even though any impact is applied to the vehicle.

What is claimed is:

1. An apparatus to adjust an angle of a seat back and a seat cushion of a vehicle, each of the seat back and the seat cushion having a supporting bracket fixed to an end thereof, the apparatus for adjusting the angle of the seat back and seat cushion comprising:

first and second turning pieces mountable to said supporting brackets of said seat back and said seat cushion, said first and second turning pieces being connectable wherein each has a connecting hole;

a connecting shaft that penetrates said connecting hole to connect said first and second turning pieces;

an actuating lever attached to said connecting shaft for turning said first and second turning pieces to raise and lower the seat back to and from the seat cushion;

an arc shaped concave portion formed on an outer surface of said first turning piece, said outer surface of said first turning piece facing a direction away from the seat back and the seat cushion;

a guiding protrusion extending away from an inner surface of said second turning piece in a direction toward the seat back and the seat cushion, said guiding protrusion having a cylindrical upper end that is guided within the concave portion by surface contact when said first and second turning pieces are connected;

a guiding groove defined by said guiding protrusion and forming a slanting jaw at a lower end of said guiding groove, said slanting jaw being concaved perpendicularly in a middle of the guiding protrusion, wherein side surfaces of the guiding protrusion are inclined inwardly relative to the slating jaw;

a latch portion provided between the connected first and second turning pieces and within the guiding groove to control an amount of stopping and turning of the turning pieces; and an actuating portion arranged in a rectangular hole defined by the latch portion to turn the connecting shaft so as to lift or lower the seat back relative to the seat cushion.

2. The apparatus according to claim 1, wherein said latch portion includes a lifting and lowering piece in the form of a plate that fits in the concave portion, said lifting and lowering piece having a concave surface formed on lower ends of both sides of the lifting and lowering piece, the concave surface being concaved inwardly to contact the slanting jaw and having the rectangular hole arranged at a middle of the lifting and lowering piece, the rectangular hole having inclined surfaces of which upper and lower surfaces are inclined in a common direction, and gears engaged with each other in a lower end surface of the lifting and lowering piece and an inner surface of the lower end of the concave portion.

3. The apparatus according to claim 1, wherein said actuating portion includes an actuating cam turnable by the connecting shaft and having contacting surfaces moved along the inclined surfaces of the upper and lower ends of the rectangular hole, and a guide pin protruding at a front and rear of the lower end of the actuating cam and inserted in a guide hole formed in the first and second turning pieces.

4. The apparatus according to claim 1, further comprising at least one coupling protrusion protruding from the outer surface of the first turning piece and the inner surface of the second turning piece to be inserted into a corresponding hole in the supporting bracket to securely couple the supporting brackets and the turning pieces.

5. The apparatus according to claim 1, further comprising a stepped portion for inserting circumferences of corners to prevent residues left at the corners thereof from exposing on surfaces when the hole and the guide hole for the first and second turning pieces are formed.

* * * * *